US005899326A

United States Patent [19]

Benhamou et al.

[11] Patent Number: 5,899,326

[45] Date of Patent: May 4, 1999

[54] CIGAR PACKAGE AND PACKAGE HAVING INTEGRAL ASHTRAY

[75] Inventors: Guy Benhamou, Beverly Hills; Marc J. Kesten, Woodland Hills, both of Calif.

[73] Assignee: OroAmerica, Inc., Burbank, Calif.

[21] Appl. No.: 09/098,767

[22] Filed: Jun. 17, 1998

[51] Int. Cl.[6] ..... B65D 85/12

[52] U.S. Cl. ..... 206/246; 206/256

[58] Field of Search ..... 206/242, 246, 206/256, 258, 268, 270, 276

[56] References Cited

U.S. PATENT DOCUMENTS

| | | | |
|---|---|---|---|
| 1,279,831 | 7/1918 | Gilbert . | |
| 1,562,497 | 10/1925 | Derry . | |
| 1,858,856 | 5/1932 | Hadley . | |
| 2,085,062 | 6/1937 | Allen . | |
| 2,396,827 | 3/1946 | Card | 206/246 |
| 2,849,154 | 8/1958 | Gartrell et al. . | |
| 2,944,555 | 7/1960 | Peel et al. . | |
| 3,024,902 | 3/1962 | Taylor . | |
| 3,090,482 | 5/1963 | Sandacz | 206/246 |
| 3,095,086 | 6/1963 | Berg . | |
| 3,126,092 | 3/1964 | Maron | 206/246 |
| 4,793,478 | 12/1988 | Tudor | 206/256 |
| 4,815,592 | 3/1989 | Kunkel . | |
| 4,850,482 | 7/1989 | Campbell . | |
| 4,912,910 | 4/1990 | Lowe et al. . | |
| 5,074,412 | 12/1991 | White . | |
| 5,158,664 | 10/1992 | Colgan et al. . | |
| 5,178,272 | 1/1993 | Evers . | |
| 5,480,025 | 1/1996 | Draucker et al. . | |
| 5,558,216 | 9/1996 | Focke et al. . | |
| 5,799,781 | 9/1998 | Arthur | 206/246 |
| 5,848,595 | 12/1998 | Arthur | 206/246 X |

*Primary Examiner*—Bryon P. Gehman
*Attorney, Agent, or Firm*—Loeb & Loeb LLP

[57] ABSTRACT

A cigar package has an outer package with walls, a top and a bottom, where the outer package of a size adapted for use in a vending machine. The cigar package includes an interior cigar-supporting insert having a cigar-supporting portion and a mounting portion. The cigar-supporting portion contains an aperture and extends across the outer package at a point between a bottom-supporting wall and a top-supporting wall such that a plane formed by the aperture is oriented transversely to a longitudinal axis of the cigar package. The mounting portion of the insert is secured to a side-supporting wall of the cigar package. The package also includes an ash compartment separate from a main storage compartment. A lid of the ash compartment is hingedly connected to a rear wall. The package includes means for securely fastening the lid to the compartment when the lid is rotated upon the lid hinge to a closed position so that the lid remains closed when the package is inverted.

19 Claims, 3 Drawing Sheets

FIG. 2
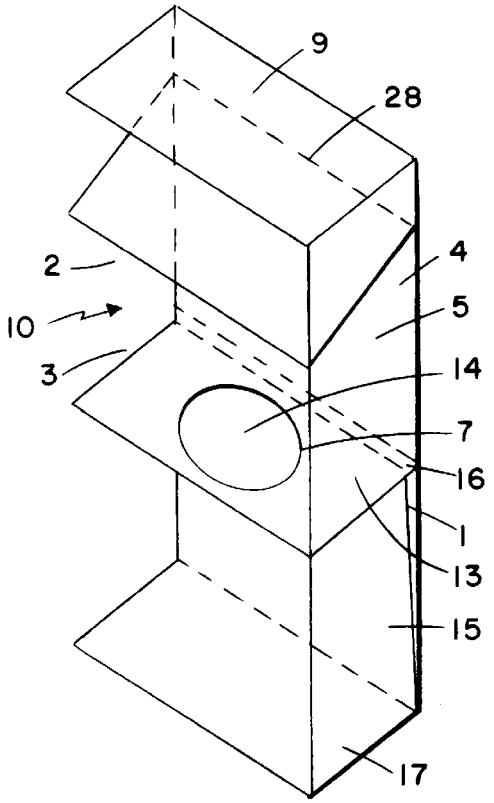
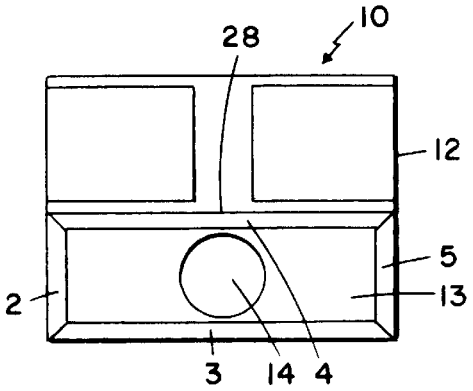
FIG. 3
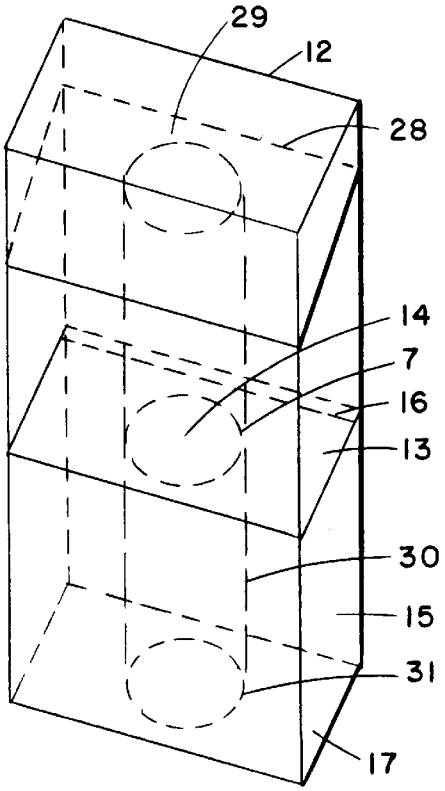
FIG. 4

CIGAR PACKAGE AND PACKAGE HAVING INTEGRAL ASHTRAY

BACKGROUND OF THE INVENTION

1. Field of the Invention

The present invention relates to a package and method used to disburse cigars in point-of-sale transactions through an already established infrastructure of cigarette or other vending machines or any other infrastructure especially adapted to accommodate the vending of cigarette packages. The invention also relates to a package for a cigar or similar smoking item incorporating an ashtray particularly well suited to a single use packaging system.

2. Description of the Related Art

There is an established infrastructure for the distribution of cigarettes through vending machine mediated, point of sale transactions. Another established infrastructure exists, for example within convenience stores, that facilitates the storage and point of sale, single package vending of cigarettes. Typical point of sale cigarette transactions are made in packages of twenty cigarettes, which is a quantity often desired for an individual's use. Cigarette packages are formed either of soft paper or thin cardboard, are generally cellophane-wrapped and generally have one of two well established and dominant sizes. The infrastructure for sale of cigarettes include vending machines or distribution racks that are designed to accommodate such packages on an individual package basis. Cigarettes thus have a well-established point of sale infrastructure for vending quantities demanded for personal use. By contrast, cigars do not have a well-established point of sale distribution channel for vending quantities demanded for personal use and have been difficult to purchase individually or in small quantities outside of specialized cigar retail establishments. Traditional cigar vending has been in the form of boxes of twenty, fifty or one hundred, which quantities cannot be considered appropriate for short term individual use. In part, the market channels conventionally preferred for cigars reflect the appreciation that cigars are best stored in environments maintained under careful moisture and temperature control. The nature of cigars and the culture of cigar smoking make single unit sales a strong preference.

Cigars are thicker than cigarettes and generally cannot be easily vended through standard vending machines that are configured for sales of packages of cigarettes having a standard size. Single cigar sales are difficult through standard cigarette vending machines because the transport mechanisms of such machines are too crude to handle the small size and the difficult cylindrical shape of cigars. In addition, cigars have leaf wrappers and often have substantially unbroken leaf tobacco contained within the leaf wrappers. This makes cigars both stiffer and more subject to damage than cigarettes, since it is undesirable to crush the tobacco leaf filler or to cut the leaf wrapper over the body of the cigar. Cigars are much more difficult to handle than cigarettes, because cigarettes are made of shredded tobacco within a paper wrapper. The somewhat delicate nature of cigars further exacerbates the difficulties of vending cigars, because vending machines are ill equipped to handle comparatively delicate products such as cigars. Because cigars are difficult to handle in their conventionally preferred sales configuration and because cigars can be somewhat delicate, it has generally not been practical to vend cigars through conventional vending machines of the type established for the vending of cigarettes.

With cigars, as with cigarettes, there is always a difficulty in disposing of the ashes produced as the article is smoked.

There have been suggestions to alter the packaging of cigarettes to provide an ash compartment integral to the cigarette package. These prior suggestions have been unsuccessful, as evidenced by the failure of these suggestions to be implemented on any commercial basis. One of the problems with the ash compartments conventionally taught is that such ash compartments tend to compress the enclosed ashes as the compartment is closed. This creates a bellows effect that undesirably expels the ashes from the ash compartment as the compartment is closed. Another limitation of the conventional suggestions is that the ash compartment is configured as a separate lid or opening into the main storage compartment of the package. When ashes are stored in such compartments, the ashes undesirably mix with the smoking articles, so that smoking articles subsequently removed from the package are covered with ashes and cannot be handled cleanly.

SUMMARY OF THE PREFERRED EMBODIMENTS

The difficulty of vending single cigars through the existing vending machine and single package distribution infrastructure limits the availability of a desirable distribution channel. It is accordingly an object of this invention to provide a package for the vending of cigars that is compatible with the existing infrastructure for the point of sale vending of cigarettes.

Another object of the invention is to provide a convenient storage space for ashes produced by a smoking article. Certain preferred embodiments of the present invention provide an ash storage space integral to a package that is particularly advantageously combined with the single cigar or limited quantity packaging preferred in accordance with other aspects of the present invention. Certain of these embodiments provide an ash compartment accessible as an ashtray by opening a lid that can be closed in a substantially secure manner.

The present invention contemplates that the cigar-package and ash compartment aspects may be incorporated in a single product or may be incorporated individually in separate products.

An aspect of the present invention provides a cigar package including an outer package having walls, a top and a bottom, the outer package of a size adapted for use in single package vending. The cigar package includes an interior cigar-supporting insert having a cigar-supporting portion and a mounting portion. The cigar-supporting portion contains an aperture and extends across the outer package at a point between a bottom-supporting wall and a top-supporting wall such that a plane formed by the aperture is oriented transversely to a longitudinal axis of the cigar package. The mounting portion of the insert is secured to a side-supporting wall of the cigar package.

Another aspect of the invention provides a vending package including an ash compartment separate from a main storage compartment. The ash compartment includes a front compartment wall, a rear compartment wall, a left side compartment wall, a right side compartment wall, and a bottom compartment wall. The ash compartment further includes means for fixedly attaching the bottom compartment wall to a bottom supporting wall of the cigarette pack which houses smoking articles. A lid is hingedly connected to at least one of the front compartment wall and the rear compartment wall and the lid includes a top compartment wall and means for securely fastening the lid to the compartment when the lid is rotated upon the lid hinge to a closed position such that the lid will remain in the closed position when the vending package is inverted.

BRIEF DESCRIPTION OF THE DRAWINGS

FIG. 2 shows a perspective view of an embodiment of the vending package with the cigar-supporting insert but without the ash compartment.

FIG. 3 shows a top view of the vending package in an open position.

FIG. 4 shows a perspective view of an embodiment of the vending package utilizing a protective cylindrical tube adapted for surrounding and supporting a cigar.

DETAILED DESCRIPTION OF THE PREFERRED EMBODIMENTS

Figure 1:
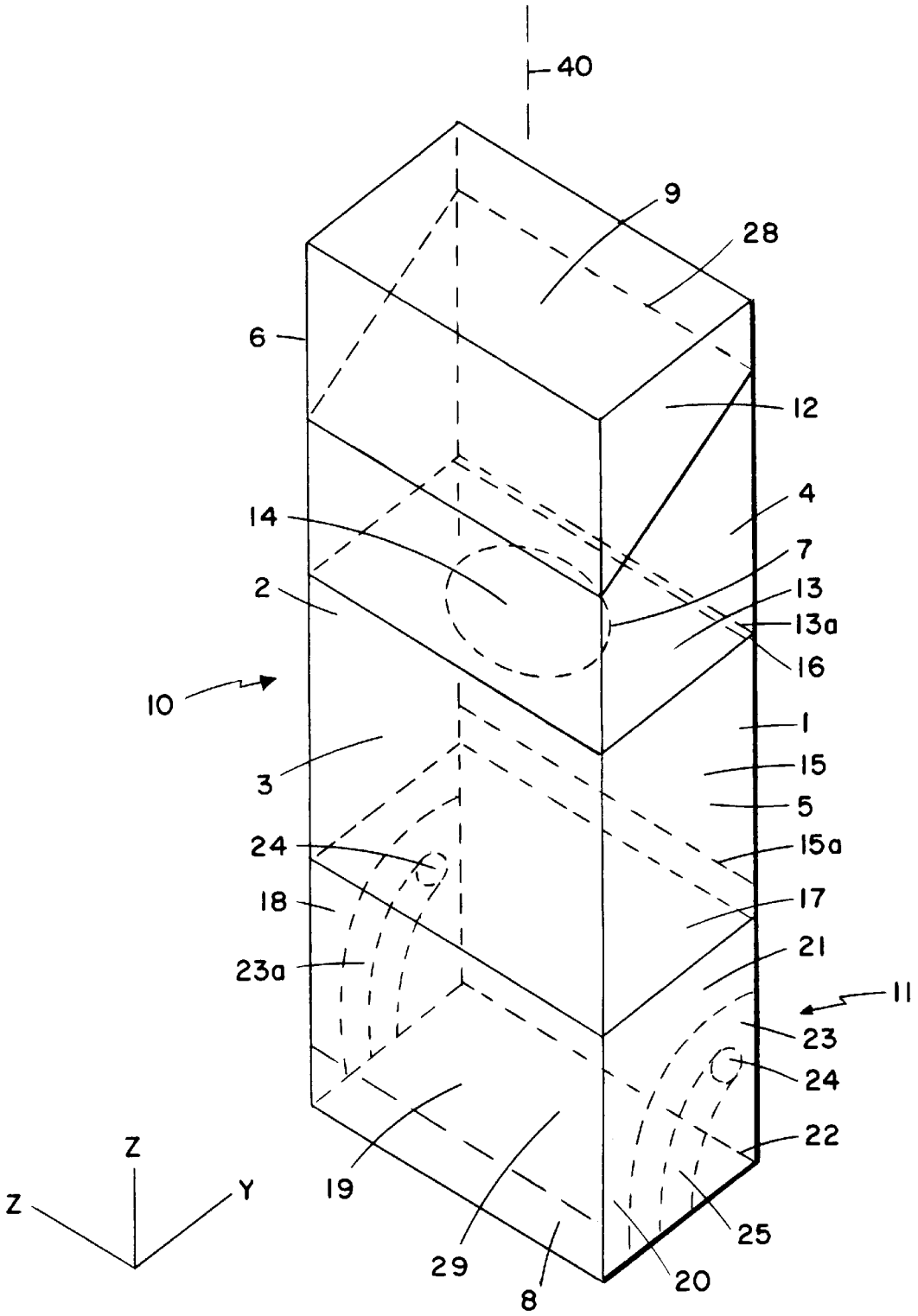
FIG. 1 shows a perspective view of a preferred embodiment of a vending package with a cigar-supporting insert and the ash compartment.

Particularly preferred embodiments of the present invention provide a vending package suitable for the vending of individual or small quantities of cigars through the available infrastructure of cigarette vending machines. This vending package might also be used in other single package vending facilities like those sometimes used, for example, in convenience stores. Preferably, the outer walls of the package are appropriately rigid and durable so that the package protects the preferred contents of a smoking article, such as a cigar, capable of being crushed or damaged in the sort of handling that might occur in loading packages into vending machines and during the transport action within the vending machine itself. Alternately, the package may be adapted for the loading and removal operations associated with other single cigarette package distribution mechanisms. To further the protection of smoking articles during vending preferred embodiments of the present invention provide a package having an insert attached to the interior of the vending package. The insert provides an aperture preferably adapted to hold a cigar securely in place to prevent damage in shipping and in the vending operation.

In many instances, the preferred configuration of the cigar vending package is adapted for carrying a single cigar, for example, by providing an insert with a single aperture. This configuration is believed to be most favorable for certain types of point of sale distribution. In other instances, it may be desirable to provide an aperture adapted for carrying two or three cigars. Such cigar quantities are also reasonable for individual, short-term use. When an insert for holding two cigars is provided, the two apertures are sized to accommodate full gauge cigars. When an insert for holding three cigars is provided the three apertures are preferably made smaller than standard gauge cigars. For either configuration, it is desirable to provide distinct, generally circular apertures separated sufficiently to allow easy access to each cigar carried.

A feature of the cigar package aspect of the present invention is a cigar-supporting insert attached to the interior of a package shaped and sized like the conventional cigarette package of the type used in vending machines. The preferred insert contains an aperture through which a cigar of standard gauge or width, but perhaps of reduced length, is placed so that the aperture and the insert cooperate to hold the cigar in a fixed position. The insert protects the cigar from damage that might otherwise occur during shipping, sales or vending operations. When multiple apertures are provided for the insert, the apertures are sized and shaped to accommodate the desired number of cigars and to protect those cigars from damage.

Other preferred aspects of the present invention provide a vending package appropriate for the vending of smoking articles having an ash compartment attached to the bottom of the vending package. Such aspects of the present invention are particularly advantageous for use with single item or limited quantity vending packages and most especially with vending packages for the vending of individual cigars. Individual article vending packages advantageously use the ash compartment of preferred embodiments because the articles vended on a single item basis can readily support the additional cost of the more complex package. In addition, the single use nature of such packages allow the ash compartment to be used without fear of having to carry ashes with a remaining store of smoking articles. The fact that the package will most likely not be carried long after use allows the ash compartment to be provided with a closing mechanism that is simple and yet safe enough for the typical use of the package. In some embodiments of the invention, it will be desirable to provide a foil or other material as a fire retardant material as a liner covering the walls of the ash compartment. Even when the compartment is to be used for ashes, it may not be desirable to line the compartment with foil or another form of liner. For example, it may instead be preferable to apply a fire retardant chemical to the paper or cardboard that makes up the walls of the ash compartment.

For single use vending packages, or for limited use vending packages, the addition of a compartment can advantageously be used for the delivery of matches, for example of a reduced size book of matches, within the limited use vending package. Alternately, the compartment might be used to distribute coupons or other promotional items. For either of these alternate uses, it may not be desirable to line the compartment with foil or other ash containing liner. In the following discussion the compartment will be referenced as an ash compartment, but it is to be understood that the compartment might have alternative or supplemental uses.

The ash compartment contemplated by the present invention maintains ashes in a separate compartment attached to the bottom of the cigar or cigarette package, with the ash compartment most preferably completely distinct from the main storage compartment of the package. In this way the stored ashes are completely isolated from the smoking articles. The ash compartment is preferably opened and closed by rotation of a lid whose operation does not disturb or expel the stored ashes. When the lid is closed, it is held securely in place such that the ashes will not fall out when the package is handled normally.

The ash compartment aspect of the present invention comprises a separately enclosed area bounded by compartment walls and a lid. During use, the user inverts the vending package, opens the lid through rotation about the lid hinge, and deposits cigar or cigarette ashes into the ash compartment. After ashes are stored in the ash compartment, the lid is rotated about the lid hinge into a closed position. A tab, side lid walls, or other friction-creating method is employed to maintain the lid in its closed position during normal handling until the user decides to again deposit ashes into the compartment or discards the package.

These and other aspects of the invention will now be described in still further detail with particular reference to the drawings. The drawings show details of the various preferred embodiments, including a combination cigar package with ash compartment attached, a cigar package without ash compartment attached, and a cigarette package with ash compartment attached.

FIG. 1 shows a preferred embodiment of the present invention that provides a cigar package 10 in combination with an ash compartment 11. The cigar package 10 comprises a hinge-top 12 cigarette box 6 of the type used in cigarette vending machines or other single package cigarette vending channels and a cigar-supporting insert 1. The cigar-supporting insert 1 is comprised of a cigar-supporting portion 13 and a mounting portion 15. The cigar-supporting portion 13 and the mounting portion 15 are most preferably formed from a single piece of material.

The cigar-supporting portion 13 extends across the cigar package 10 at a point 13*a*between the bottom-supporting wall 17 and the top-supporting wall 9. Point 13*a* is preferably located midway between the bottom 17 and the top 9 supporting walls. However, the location of this point 13*a* may be selected as that which allows the cigar-supporting portion 13 to best support and secure the cigar in a relatively fixed position. The cigar-supporting portion 13 contains an aperture 14 that holds the cigar in place. The aperture 14 is of a size and shape such that it can hold a standard-width cigar securely in place whether the cigar is wrapped or unwrapped. If additional cigars are to be carried, additional apertures are provided, with the apertures typically spaced apart and from the walls of the package by equal distances. Typically, cigars within the package are wrapped in cellophane or other similar material. The shape of the aperture 14 is substantially circular, as defined by the aperture edge 7. The cigar-supporting portion 13 is oriented such that a plane formed by the aperture 14 is oriented transversely to a longitudinal axis of the package 40. Although such an orientation of the cigar-supporting portion 13 would provide the best support for the cigar, other orientations may also be employed.

The mounting portion 15 of the cigar-supporting insert is attached to one or more of the four cigarette box supporting walls 2, 3, 4, 5 of the cigarette package 6. The mounting portion 15 may be attached by any conventional method, such as, for example, gluing. As shown in this embodiment, the space 16 between the mounting portion 15 and the cigarette package rear supporting wall 4 may be present if the mounting portion 15 is attached to the cigarette package rear supporting wall 4 significantly closer to bottom supporting wall 17 than to point 13*a*. FIG. 1 shows a particular embodiment where the mounting portion 15 is attached to the cigarette package rear-supporting wall 4 at point 15*a*. Point 15*a* may be located anywhere within the interior of the cigar package 10 and ideally should be located so that the cigar-supporting portion provides the cigar with the greatest support.

When the cigar package 10 is used, a cigar is placed through the aperture 14 and may rest upon the bottom-supporting wall 17. Friction created by the contact between the aperture edge 7 and the cigar prevents the cigar from moving during shipment or the vending operation. Thus, the cigar is oriented in a direction substantially parallel to a longitudinal axis of the cigar package 10. After the vending operation is complete, the user opens the hinge-top 12 of the cigar package 10 and removes the cigar from the cigar-supporting portion 13.

Also shown in FIG. 1 is the ash compartment 11 aspect of the present invention. The ash compartment 11 comprises a front compartment wall 19, a rear compartment wall 21, a left side compartment wall 18, a right side compartment wall 20, a bottom compartment wall 17, and a lid 29 which also functions as the top compartment wall 29 when the lid is in a closed position as depicted in FIG. 1. The six compartment walls 17, 18, 19, 20, 21, 29 fully enclose the space in which ashes are stored. The dimensions of the compartment walls 17, 18, 19, 20, 21, 29 in the X and Y directions are preferably identical to those of the cigarette box supporting walls 2, 3, 4, 5. However, the height of the compartment walls 17, 18, 19, 20, 21, 29 in the Z direction may be of any dimension, which dimension is limited only by the maximum height constraints of cigarette packages used in vending machines. For example, given a maximum height constraint, the longer the cigar package 10 component of the present embodiment, the shorter the allowable height in the Z direction of the ash compartment 11, and vice-versa. The bottom compartment wall 17 of the ash compartment 11 also serves as the bottom-supporting wall 17 of the cigar package 10. Thus, the ash compartment 11 may be constructed separately from the cigar package 10 and subsequently attached by any conventional method to the bottom-supporting wall 17 of the cigar package 10. Alternatively, the ash compartment 11 may be incorporated directly into the blank from which the cigar package 10 is constructed. Furthermore, the ash compartment 1 may be lined with a protective material, such as foil. The foil serves to retard fire and prevent smoldering ashes from burning into the package. Other fire retardant strategies might alternately be used. For example, the paper or cardboard of the ash compartment might alternately be treated with one of the commonly know fire retardant chemicals.

The lid 29 is hingedly connected to either the front 19 or rear 21 compartment wall and rotates about the lid hinge 22. The lid 29 is held securely in place when it is in a closed position, by a tab 8. The tab 8 is attached to an outer edge of the lid 29, runs the length of the lid 29 and extends in a substantially perpendicular direction away from the lid 29 towards the top of the cigar package 10. A friction is created between the tab 8 and the front 19 or rear 21 compartment wall against which it rests which prevents the lid 29 from being jarred open by the inverting and handling of the cigar package 10 which would occur during normal use. In another embodiment, the lid 29 is held securely in place when it is in a closed position by left side lid wall 23*a* and right side lid wall 23. The side lid walls 23 and 23*a* may be of any shape, but preferably consist of quarter-circle sections. The side lid walls 23 and 23*a* are attached to the outer edges of the lid 29, extend in a substantially perpendicular direction away from the lid 29 towards the top of the cigar package 10, and rest against the interior of the ash tray compartment when the lid 29 is in a closed position. Attached to the outer-facing edge of each side lid wall 23, 23*a* is a raised bump 24. Each raised bump 24 extends in a substantially perpendicular direction away from the side lid wall 23, 23*a* to such a length, ideally no more than a millimeter or two, so that when the lid 29 is in a closed position each raised bump 24 is pressed against the interior of its adjacent side compartment wall 18, 20. Thus, a friction fit is created between each raised bump 24 and its adjacent side compartment wall 18, 20 which prevents the lid 29 from being jarred open by the inverting and handling of the cigar package 10 which would occur during normal use. When the lid 29 is rotated about its hinge 22 each raised bump 24 follows an arcuate track 25. The arcuate track 25 is a depression made upon the interior of each side compartment wall 18, 20. In an alternative embodiment, the arcuate track 25 is impressed upon the outer facing side of each side lid wall 23, 23*a* and each raised bump 24 is attached to the interior of each side compartment wall 18, 20, such that each raised bump 24 remains in a fixed position during rotation of the lid 29 about its hinge 22.

These components of the cigar package 10 may be made out of any material suitable for a cigarette box which is typically used in cigarette vending machines, such as, for example, cardboard or heavy paper.

FIG. 2 shows an embodiment of the present invention which provides a cigar package 10 without the attached ash compartment 11. An advantage of this particular embodiment is that the absence of the ash compartment 11 allows for a longer overall length of the cigar package 10 which thereby permits the vending of longer cigars. The only constraint on the length of the cigar package 10 without attachment of the ash compartment 11 is the maximum length limit of cigarette packages used in cigarette vending machines. The remaining features of this embodiment are similar to those of the cigar package 10 portion shown in FIG. 1 and so are not described further.

FIG. 3 shows a top view of the cigar package 10 with the hinge-top 12 rotated fully about its hinge 28 to an open position. The aperture 14 is located in what is substantially the middle of the cigar-supporting portion 13. Also shown are the visible portions of the cigarette box supporting walls 2, 3, 4, 5 located above the cigar-supporting portion 13. In this embodiment, no space is shown between the cigar-supporting portion 13 and the rear cigarette box-supporting wall 4.

FIG. 4 shows another embodiment of the present invention wherein the cigar package 10 further comprises a tube 30. The cigar is placed within the tube 30 for added support and protection. The tube 30 may be of any size and shape, but is preferably cylindrical and of a diameter sufficient to hold the cigar securely in place while still allowing for easy removal of the cigar by the user. The tube 30 is placed through the aperture 14 and may rest upon the bottom-supporting wall 17. The tube 30 may further be attached by any conventional method to the bottom-supporting wall 17 for added stability and support. The tube 30 comes into contact with the aperture edge 7 and may be attached thereto by any conventional method. The top 29 of the tube 30 extends upwards away from the cigar-supporting portion 13 to any length which will still allow complete closure of the hinge-top 12. In use, the cigar is held secure by the tube 30 until removed by the user after the vending operation is complete. Should the package be adapted for carrying two or more cigars, it may be desirable to include separate tubes for each of the two or three apertures to be provided for carrying the two or three cigars.

Figure 5:
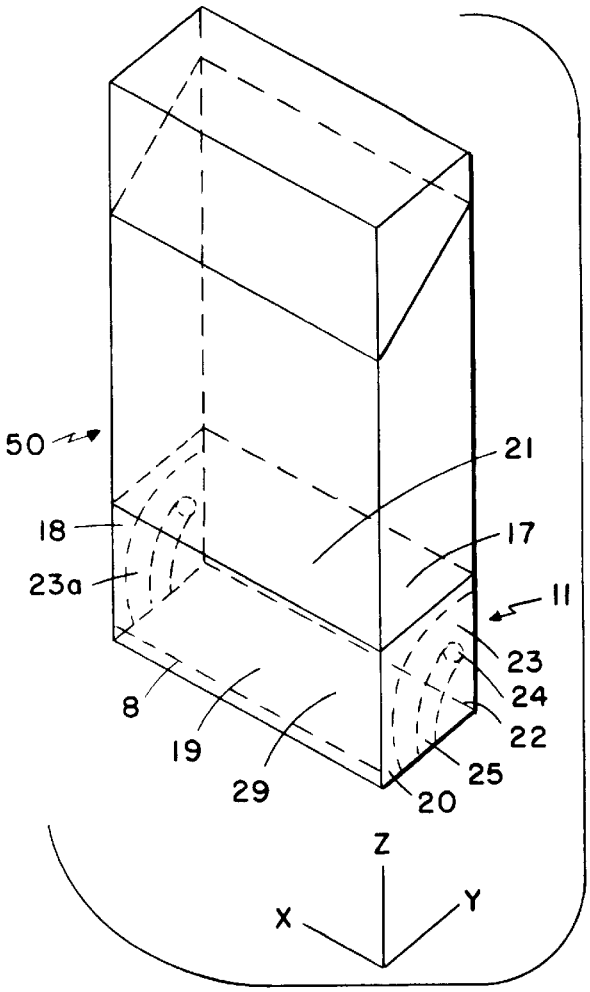
FIG. 5 shows a perspective view of an embodiment of a vending package with the ash compartment attached.

FIG. 5 shows yet another embodiment of the present invention including a cigarette package 50 provided with an ash compartment 11. For cigarette packages not intended for use in cigarette vending machines, the height of the ash compartment 11 in the Z direction is limited only by such considerations as cost of materials and user convenience. The remaining features of the ash compartment 11 in this embodiment are similar to those depicted in FIG. 1.

Figure 6:
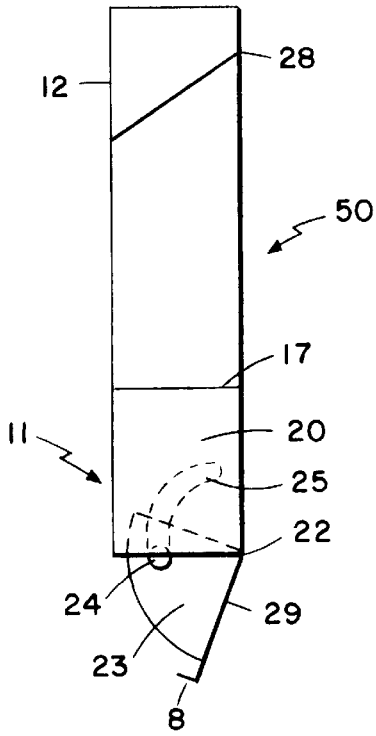
FIG. 6 shows a side view of the vending package with the ash compartment lid in an open position.

FIG. 6 shows a side view of the cigarette package 50 with the lid 29 of the ash compartment 11 in an open position. The raised bump 24 follows the arcuate track 25 which is impressed upon the interior of the side compartment wall 20. During use, the cigarette package 50 is inverted such that ashes which are deposited into the ash compartment 11 rest against the bottom compartment wall 17. When use of the ash compartment 11 ends, the user closes the lid 29 and inverts the cigarette package 50 to its normal upright position. The tab 8 and the raised bump 24 and arcuate track 25 combination maintain the lid 29 in a closed position during inverting and normal handling of the cigarette package 50.

Figure 7:
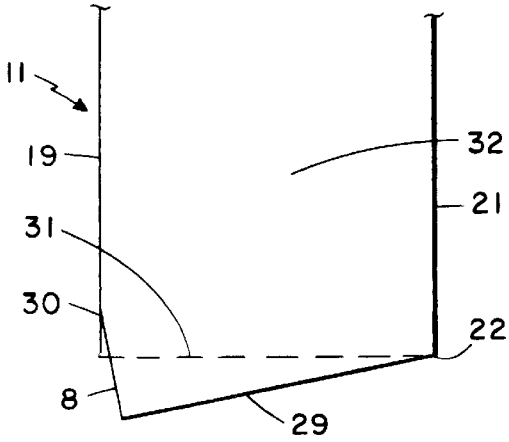
FIG. 7 shows a close-up side view of the vending package and the ash compartment lid and tab in a semi-closed position.

FIG. 7 shows a close-up side view of the ash compartment 11 with the lid 29 in a semi-closed position. As the lid 29 is rotated upon its hinge 22 to a closed position, the tab 8 strikes the front compartment wall 19. As the lid 29 is rotated further, the tab 8 is forced to bend inward towards the center 32 of the ash tray compartment 11 as a result of the contact between the tab 8 and the front compartment wall 19. The tab 8 exerts force against the front compartment wall 19 as it attempts to return to an orientation which is substantially perpendicular to the lid 29. In its closed position, the tab 8 rests substantially flat against the front compartment wall 19. The force exerted by the tab 8 as the lid 29 begins to rotate from its closed position creates a friction which must be overcome by the user in order to open the lid 29. This friction keeps the lid 29 securely in place in its closed position.

Figure 8:
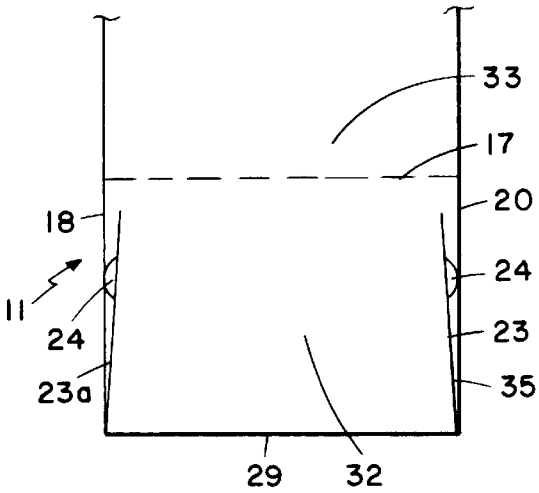
FIG. 8 shows a front view of the ash compartment lid and side lid walls in a closed position.

FIG. 8 shows a close up front view of the ash compartment 11 with the lid 29 in a closed position. The raised bumps 24 are shown resting against the side compartment walls 18, 20. The raised bumps 24 force the side lid walls 18, 20 to flex inwards towards the center of the ash compartment 11. As the side lid walls 18, 20 attempt to return to an orientation substantially perpendicular to the lid 29, they force the raised bumps 24 against the side compartment walls 18, 20. This force creates a friction fit between the raised bumps 24 and the side compartment walls 18, 20 that keeps the lid 29 securely in place in its closed position.

Having described the invention, it will be apparent to those skilled in the art that modifications may be made without departing from the spirit and scope of the present invention as defined in the appended claims. Those of ordinary skill in the art will appreciate that certain variations and modifications on the particularly described embodiments may be made without varying from the teachings of the present invention. It should be appreciated that there may be certain variations in the package appropriate to cigarette vending machines and the package appropriate to other single package vending channels. In the following claims, therefore, the term vending is intended to encompass these various single package, personal use quantity vending channels.

We claim:

1. A cigar package comprising:

an outer package having walls, a top and a bottom, the outer package of a size adapted for single package vending; and an interior cigar-supporting insert having a cigar-supporting portion and a mounting portion;

wherein the cigar-supporting portion contains an aperture, wherein the cigar-supporting portion extends across the outer package at a point between a bottom-supporting wall and a top-supporting wall such that a plane formed by the aperture is oriented transversely to a longitudinal axis of the cigar package, and wherein the mounting portion of the insert is secured to a side supporting wall of the cigar package.

2. The cigar package of claim 1, wherein the cigar-supporting portion of the insert is located at a point substantially midway between the bottom supporting wall and the top supporting wall, the point being selected to hold a cigar securely with respect to the outer package.

3. The cigar package of claim 2, wherein the aperture is circular or oval in shape.

4. The cigar package of claim 3, wherein the aperture is of sufficient size to securely hold a cigar wrapped in protective material.

5. The cigar package of claim 3, further comprising a cylindrical tube placed through and held secure by the aperture; the tube being of sufficient diameter to contain a standard gauge cigar.

6. The cigar package of claim 1, wherein the size of the outer package is appropriate to single package cigarette vending machines.

7. The cigar package of claim 6, wherein the cigar-supporting portion contains at least one aperture, the cigar package further comprising at least one cigar.

8. The cigar package of claim 1, wherein the cigar-supporting portion contains three apertures.

9. The cigar package of claim 1, wherein the cigar-supporting portion contains two apertures.

10. The cigar package of claim 9, further comprising at least two cigars.

11. The cigar package of claim 1, wherein the cigar-supporting portion contains only one aperture.

12. A vending package including an ash compartment separate from a main storage compartment, the ash compartment comprising:

a front compartment wall, a rear compartment wall, a left side compartment wall, a right side compartment wall, and a bottom compartment wall;

means for fixedly attaching the bottom compartment wall to a bottom supporting wall of the vending package which houses smoking articles; and a lid hingedly connected to at least one of the front compartment wall and the rear compartment wall, the lid comprising a top compartment wall and means for securely fastening the lid to the compartment when the lid is rotated upon the lid hinge to a closed position such that the lid will remain in the closed position when the vending package is inverted.

13. The vending package of claim 12, wherein the means for securely fastening the lid to the compartment includes a tab which extends the length of the top compartment wall parallel to the hinge, which tab extends substantially perpendicular to the top compartment wall in a direction towards the interior of the compartment and which tab extends in the substantially perpendicular direction to a length sufficient to allow closure of the lid such that a friction is created by the contact between the tab and the front or rear compartment wall upon closure of the lid.

14. The vending package of claim 12, wherein the means for securely fastening the lid to the compartment includes a left side lid wall and a right side lid wall, each of the side lid walls fixedly attached at an outer edge of the top compartment wall and extending substantially perpendicular to the top compartment wall in a direction towards the compartment, the walls extending in the substantially perpendicular direction to a length not greater than the length of the edge of the top compartment wall to which they are fixedly attached, each of the walls having on an outer-facing surface at least one fixed raised bump, the raised bumps extending in a direction substantially perpendicular to the side lid wall and extending in the direction to a length sufficient to allow closure of the lid such that a friction is created by the contact between each raised bump and the corresponding side compartment wall against which it rests when the lid is in a closed position.

15. The vending package of claim 14, wherein each raised bump follows an arcuate track when the lid is rotated upon the lid hinge, said arcuate track comprising a depression formed on the interior of each side compartment wall.

16. The vending package of claim 12, wherein the ash compartment is lined with a protective material.

17. The vending package of claim 12, wherein the main storage compartment comprises:

an outer package having walls, a top and a bottom, the outer package of a size adapted for use in a vending machine; and an interior cigar-supporting insert having a cigar-supporting portion and a mounting portion;

wherein the cigar-supporting portion contains an aperture, wherein the cigar-supporting portion extends across the outer package at a point between a bottom-supporting wall and a top-supporting wall such that a plane formed by the aperture is oriented transversely to a longitudinal axis of the cigar package, and wherein the mounting portion of the insert is secured to a side supporting wall of the cigar package.

18. The vending package of claim 12, further comprising matches contained within the ash compartment.

19. The vending package of claim 12, wherein at least an interior of the ash compartment is made fire retardant.

* * * * *